US005973307A

United States Patent [19]

Cho

[11] Patent Number: 5,973,307

[45] Date of Patent: Oct. 26, 1999

[54] HIGH VOLTAGE TRANSFORMER WITH SIDE INSULATION SUPPORT AND FORMED WITH THROUGH-HOLES FOR LEAD WIRES

[75] Inventor: Pung Yeun Cho, Suwon, Rep. of Korea

[73] Assignee: Samsung Electronics Co., Ltd., Suwon, Rep. of Korea

[21] Appl. No.: 08/933,333

[22] Filed: Sep. 18, 1997

[30] Foreign Application Priority Data

Sep. 21, 1996 [KR] Rep. of Korea ..... 96-30487

[51] Int. Cl.[6] ..... H05B 6/64

[52] U.S. Cl. ..... 219/760; 336/98

[58] Field of Search ..... 336/183, 206; 219/760, 715

[56] References Cited

U.S. PATENT DOCUMENTS 5,200,731 4/1993 Tochio et al. ..... 336/98

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A high voltage transformer, especially for use in a microwave oven is provided. The high voltage transformer includes: a primary coil to which a commercial power supply is connected; a secondary coil for inducing a high voltage necessary for driving a magnetron of the microwave oven, with respect to the primary coil; a heater coil for inducing voltage necessary for heating a negative electrode of the magnetron, with respect to the primary coil; a core for forming a common magnetic path for the primary and secondary coils and the heater coil; and an insulation support including a side insulating member disposed between the primary, secondary and heater coils and the core, a bottom insulating member disposed between the bottom of the secondary coil and the core and a lead wire support integrally combined with the side insulating member and the bottom insulating member and formed with holes through which lead wires of the secondary coil pass. Accordingly, the insulation characteristic of the coils with respect to the core is improved and the coils can be prevented from being damage. Further, the probability of an electric shock due to exposure of terminals, especially at a high voltage side, of the transformer can be reduced and an assembly efficiency thereof can be increased.

7 Claims, 5 Drawing Sheets

HIGH VOLTAGE TRANSFORMER WITH SIDE INSULATION SUPPORT AND FORMED WITH THROUGH-HOLES FOR LEAD WIRES

BACKGROUND OF THE INVENTION

The present invention relates to a high voltage transformer, and more particularly, to a high voltage transformer for use in a microwave oven.

A microwave oven cooks foods by dielectrically heating the foods by microwaves emitted from a magnetron thereof.

As shown in FIG. 1, a microwave oven generally includes a body frame 1 having a cooking room 5 and a component room 6, an external case 2 for surrounding the body frame 1, a door 3 for closing/opening the cooking room 5 and a control panel 4 for a user operation. Installed in the component room 6 are, a magnetron 7 for emitting a microwaves, a high voltage transformer 8 for generating a necessary voltage between positive and negative electrodes of the magnetron 7, a high voltage capacitor 9 for charging and discharging a high-voltage output of a secondary side of the high voltage transformer 8 to supply the high-voltage output to the positive electrode of the magnetron 7, and a cooling fan 10 for preventing the magnetron 7 from overheating Here, since the high voltage transformer 8 generates the necessary voltage to the positive and negative electrodes of the magnetron 7 from a commercial power source (AC 110/220 V), and especially generates the high voltage to the positive electrode of the magnetron 7 at the secondary side thereof, a superior insulation for the high voltage is required for the high voltage transformer 8 and it is necessary to handle the transformer carefully.

As shown in FIG. 5, a conventional high voltage transformer for a microwave oven includes a shell type core having an I-type core member 34*a* and an E-type core member 34*b*, primary and secondary coils 31 and 32 which are inserted into the core, and a heater coil 33 installed between the primary and secondary coils 31 and 32. Pass cores 42 and 42' are installed between the primary coil 31 and the heater coil 33 to fill up a space inside the core. For insulation with respect to the inner walls of the core, the primary and secondary coils 31 and 32 and the heater coil 33 are wrapped up in insulators 38 and 38', 39 and 39', 40 and 40', and 41 and 41', respectively. The pass cores 42 and 42' are insulated by mica sheets 43 and 43'.

Terminal boards 36 and 37 each having terminals 36*a* and 36*a'* and 37*a* and 37*a'* are attached to the primary and secondary coils 31 and 32 by an insulating tape (not shown), respectively. Lead wires 31*a* and 31*a'* and 32*a* and 32*a'* for the respective coils 31 and 32 are soldered to the terminals 36*a* and 36*a'* and 37*a* and 37*a'*, respectively. The terminals 36*a* and 36*a'* of the primary terminal board 36 are connected to the external commercial power source and the terminals 37*a* and 37*a'* of the secondary terminal board 37 are connected to the high voltage capacitor.

In the above-described high voltage transformer, since the terminals, especially the secondary terminals at which the high voltage is induced are exposed to the outside, there is a probability of an electric shock, for example, in the state that the external case 2 is disassembled from the microwave oven for repair, as shown in FIG. 1.

Furthermore, for the installation of the terminal boards during assembling the high voltage transformer, the steps of soldering the lead wires of the coils to the terminals of the terminal boards, primarily attaching the insulating tape to the portions of the coils to which the terminal boards are attached and then fixing the terminal boards to the coils using the insulating tape are required. However, the taping processes are boresome and time-consuming.

SUMMARY OF THE INVENTION

It is an object of the present invention to provide a high voltage transformer which is improved in the insulation structure of a secondary coil thereof to reduce the probability of an electric shock and to improve the assembly efficiency.

To accomplish the above object, according to one aspect of the present invention, there is provided a high voltage transformer comprising: at least two coils each having lead wires, for generating a mutual induced electromotive force; a core for forming a common magnetic path for the coils; and an insulation support including a side insulating member disposed between at least one of the coils and the core and a conventional lead wire support integrally combined with the side insulating member and formed with holes through which the lead wires pass.

Here, it is preferable that the insulation support further includes a bottom insulating member disposed between the bottom of the at least one of the coils and the core, and that the side insulating member of the insulation support extends upward to the height of the other of the coils.

Preferably, the insulation support is made of plastics.

According to another aspect of the present invention, there is provided a high voltage transformer comprising: a primary coil to which a commercial power supply is connected; a secondary coil for inducing a high voltage necessary for driving a magnetron, with respect to the primary coil; a heater coil for inducing voltage necessary for heating a negative electrode of the magnetron, with respect to the primary coil; a core for forming a common magnetic path for the primary and secondary coils and the heater coil; and an insulation support including a side insulating member disposed between the primary, secondary and heater coils and the core, a bottom insulating member disposed between the bottom of the secondary coil and the core and a lead wire support integrally combined with the side insulating member and the bottom insulating member and formed with holes through which lead wires of the secondary coil pass.

BRIEF DESCRIPTION OF THE DRAWINGS

The above object and advantage of the present invention will become apparent by describing in detail a preferred embodiment thereof with reference to the accompanying drawings in which.

DETAILED DESCRIPTION OF THE INVENTION

Figure 1:
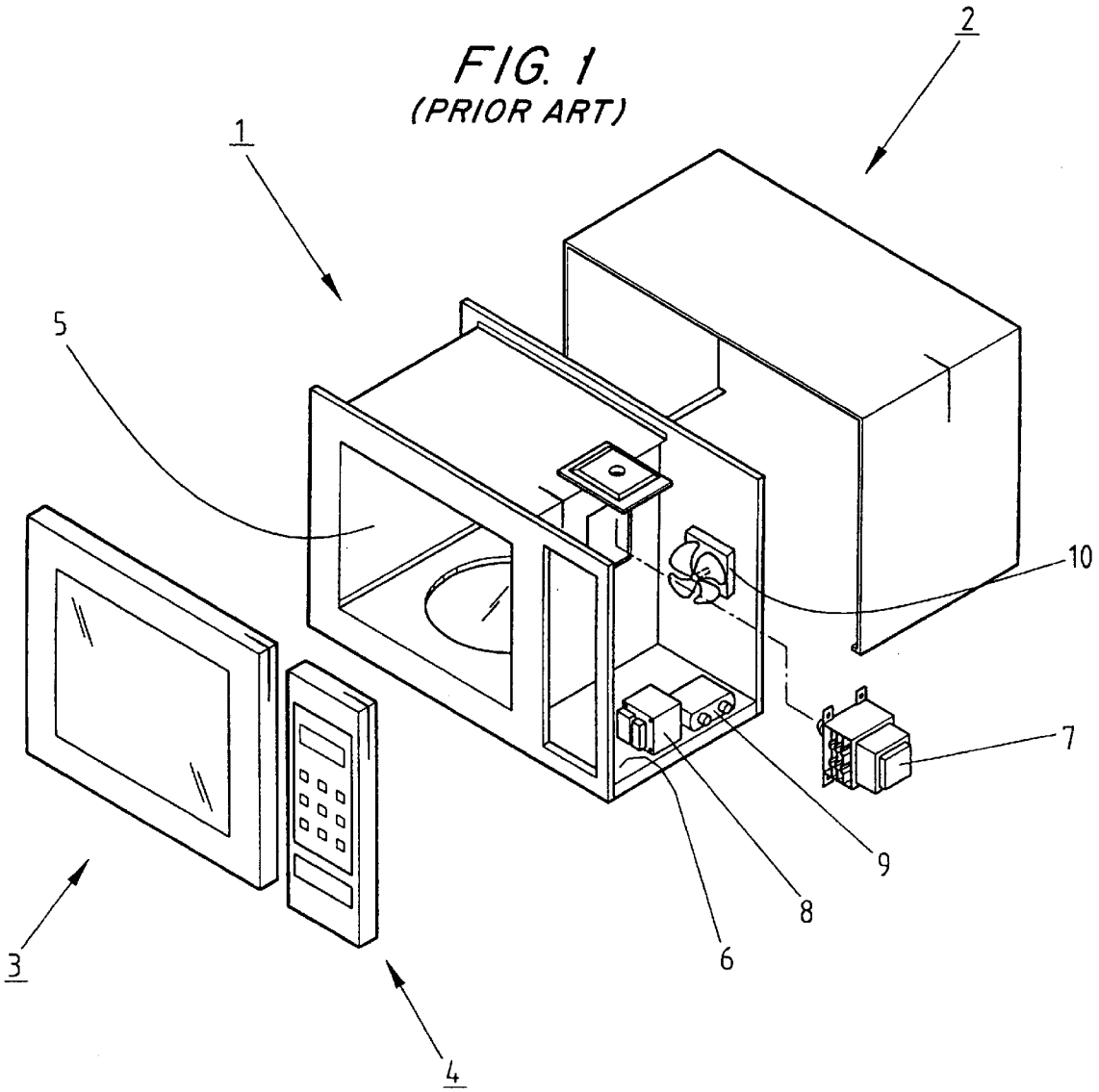
FIG. 1 (PRIOR ART)
FIG. 1 shows an exploded perspective view of a microwave oven in which a high voltage transformer is installed.
Figure 2:
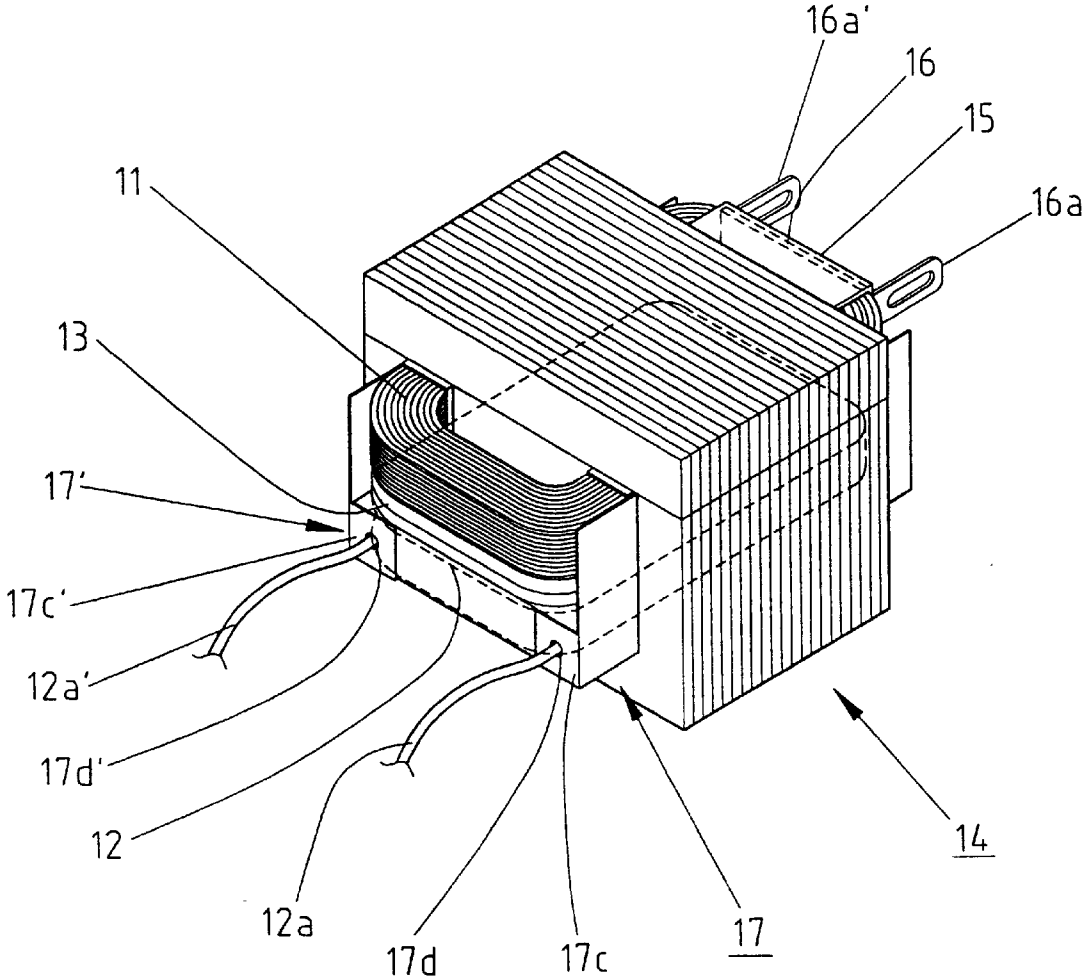
FIG. 2 shows a perspective view of a high voltage transformer according to the present invention, for driving a magnetron of a microwave oven.
Figure 3:
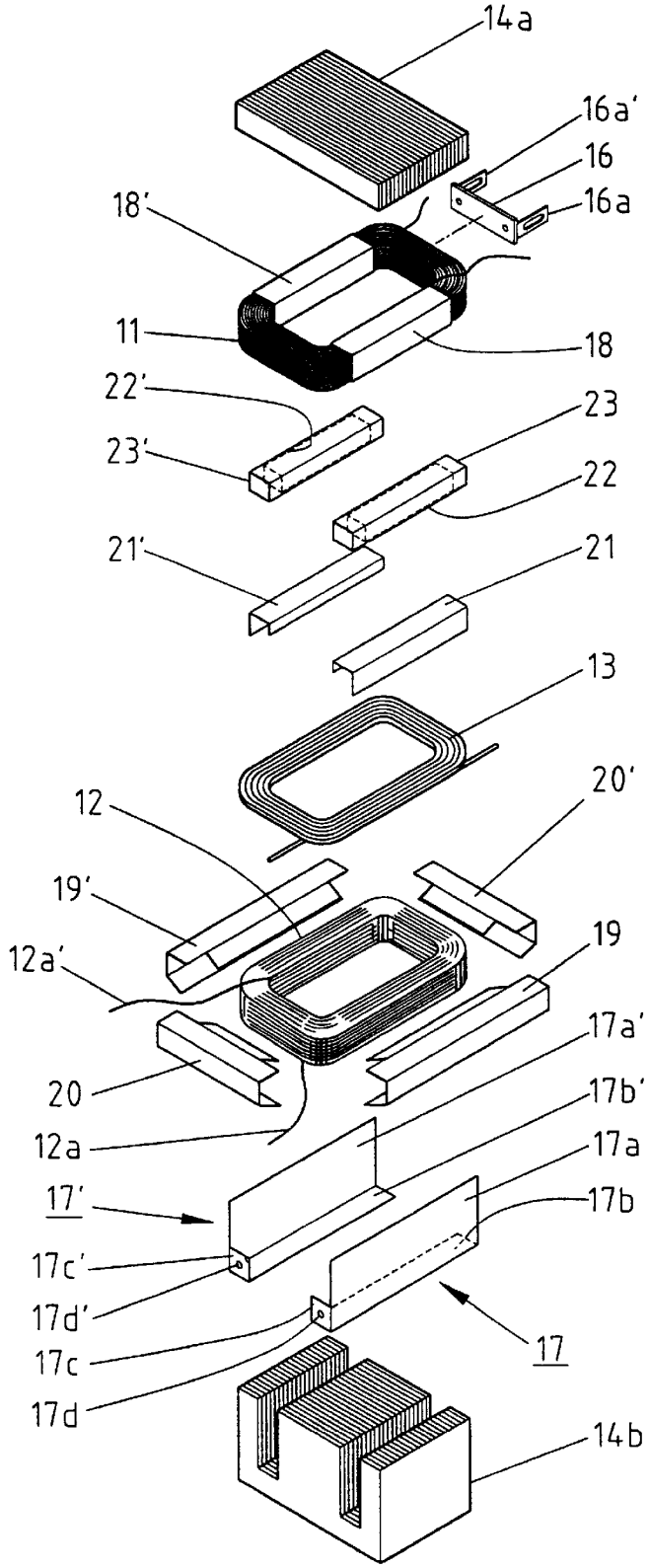
FIG. 3 shows an exploded perspective view of the high voltage transformer in FIG. 2.

Referring to FIGS. 1 to 3, a high voltage transformer according to the present invention, for example, for use in a microwave oven includes a primary coil 11 to which an external commercial power source is connected, a secondary coil 12 for generating a necessary high voltage to a positive electrode of a magnetron 7 of the microwave oven, a heater coil 13 for heating a negative electrode of the magnetron 7, and a shell type core 14 having an I-type core member 14*a* and an E-type core member 14*b* for forming a common magnetic path for the primary and secondary coils 11 and 12 and the heater coil 13. The high voltage transformer further includes insulation supports 17 and 17' which are installed between the respective long sides of the primary, secondary and heater coils 11, 12 and 13 and the inner walls of the core 14. The insulation supports 17 and 17' have lead wire supports 17*c* and 17*c'* formed with holes 17*d* and 17*d'* through which lead wires 12*a* and 12*a'* of the secondary coil 12 pass. The lead wires 12*a* and 12*a'* are directly or indirectly connected to the above-mentioned high voltage capacitor. A terminal board 16 having terminals 16*a* and 16*a'* is attached to the primary coil 11 by an insulating tape 15. The primary coil 11 is connected to the external commercial power source through the terminals 16*a* and 16*a'* of the terminal board 16. Lead wires (not shown) of the heater coil 13 are connected to the negative electrode of the magnetron 7.

Referring to FIG. 3, the I-type and E-type core members 14*a* and 14*b* forming the core 14 are respectively formed by stacking thin silicon steel plates and integrally combined with each other by welding, as shown in FIG. 2.

Figure 4:
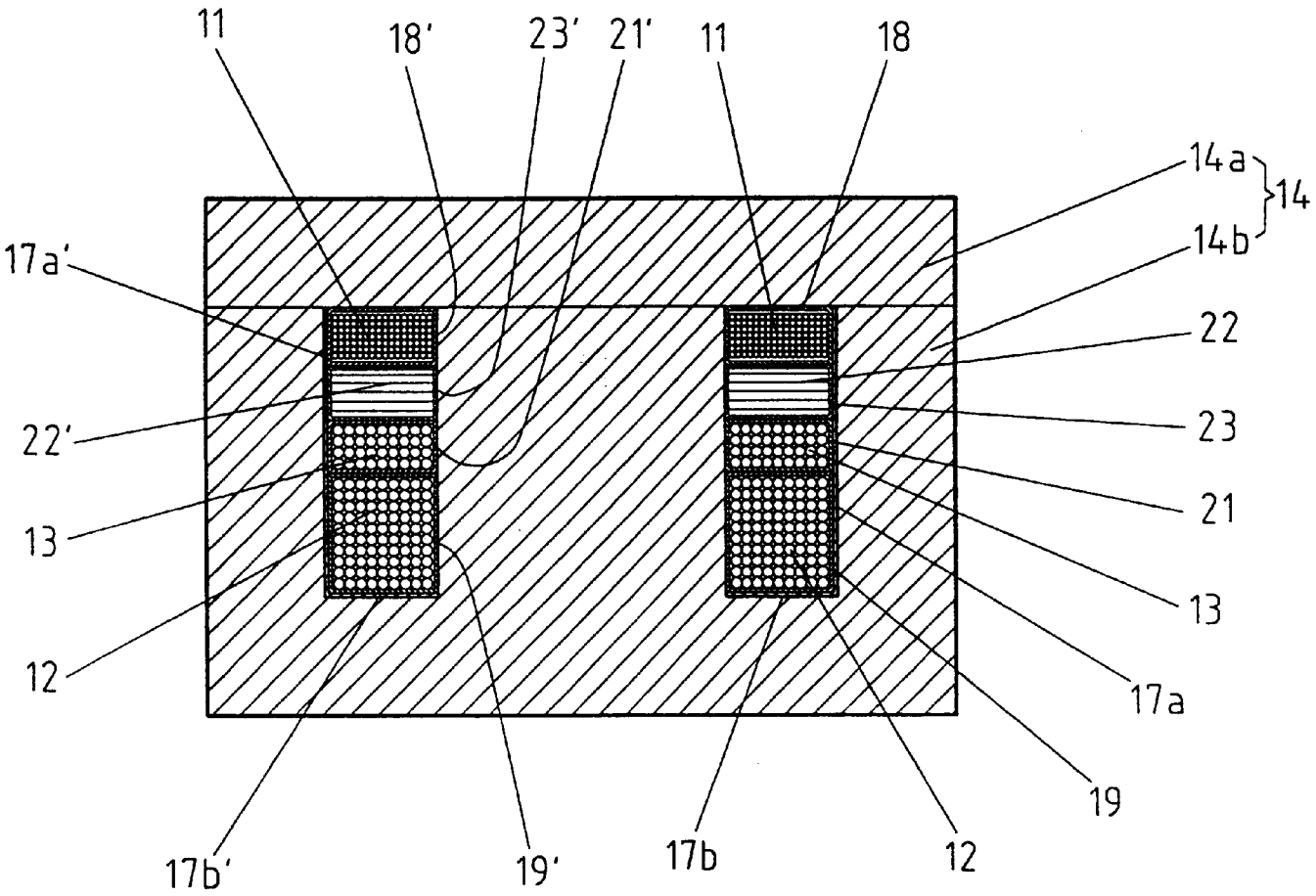
FIG. 4 shows an elevational section of the high voltage transformer in FIG. 2.
Figure 5:
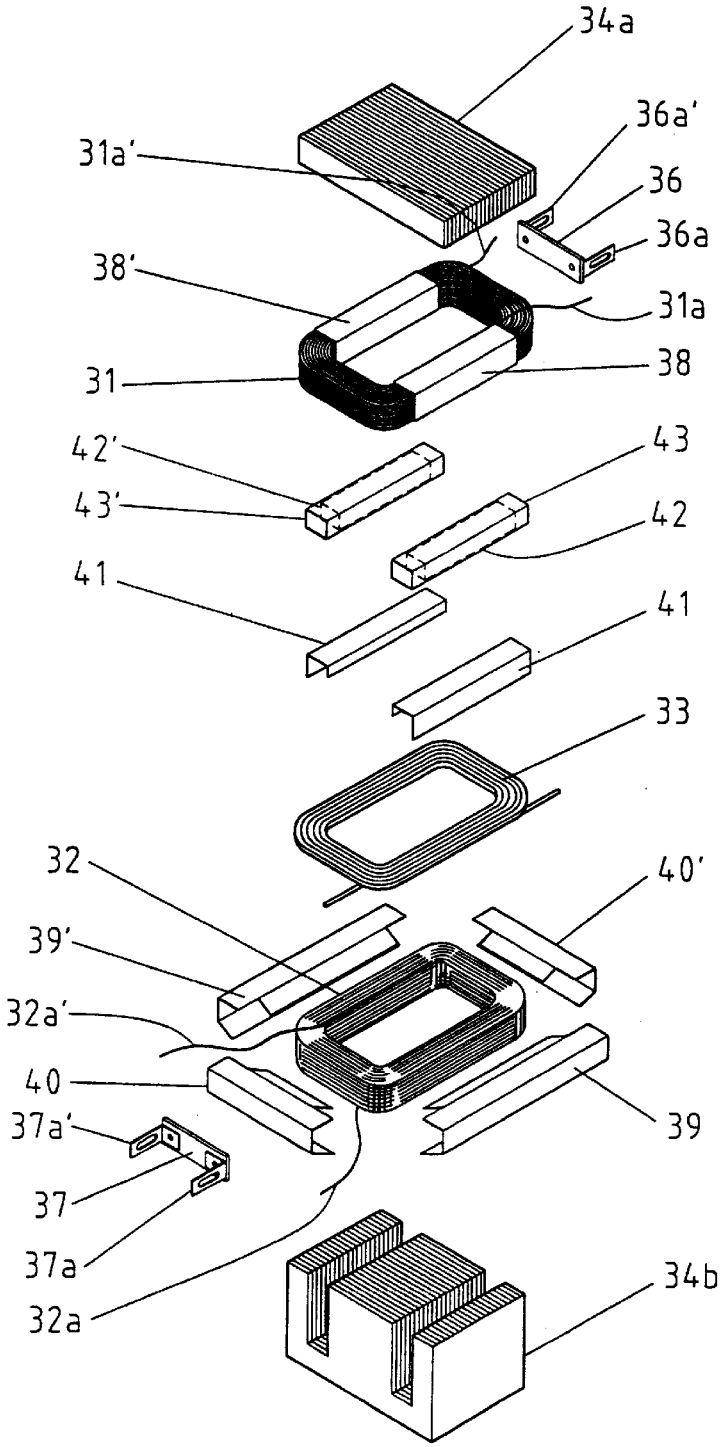
FIG. 5 (PRIOR ART)
FIG. 5 shows an exploded perspective view of a conventional high voltage transformer for use in a microwave oven.

Referring to FIG. 4, for the insulation with respect to the inner walls of the core 14, the primary and secondary coils 11 and 12 and the heater coil 13 are wholly or partly wrapped up in insulators 18 and 18', 19 and 19', 20 and 20', and 21 and 21', respectively. Pass cores 22 and 22' are installed between the primary coil 11 and the heater coil 13 to fill up a space inside the core 14. The pass cores 22 and 22' are insulated by mica sheets 23 and 23', respectively.

The insulation supports 17 and 17' include side insulating members 17*a* and 17*a'* extending upward to the height of the primary coil 11, bottom insulating members 17*b* and 17*b'*, for the insulation with respect to the inner walls of the core 14, and the lead wire supports 17*c* and 17*c'* which are attached to the one ends of the side and bottom insulating members 17*a* and 17*a'* and 17*b* and 17*b'*, respectively. Preferably, the insulation supports 17 and 17' are made up of plastics.

As described above, the lead wire supports 17*c* and 17*c'* are formed with the holes 17*d* and 17*d'*, through which the lead wires 12*a* and 12*a'* of the secondary coil 12 pass, respectively. The insulation supports 17*c* and 17*c'* enhance the insulation characteristics between the primary, secondary and heater coils 11, 12 and 13 and the inner walls of the core 14. Moreover, the insulation supports 17*c* and 17*c'* shelter parts of the coils which protrude toward front and rear sides of the core 14 to prevent contacts with an external tool such as a screw driver, or especially a sharp knife, thereby preventing the coating of the coils from being damaged.

It will be easily appreciated that the above-structured insulation supports can be provided for every lead wire of the primary and secondary coils and the heater coil.

The high voltage transformer according to present invention can be applied to other apparatuses than the magnetron of the microwave oven.

As described above, according to the high voltage transformer of the present invention, the probability of the electric shock due to the exposure of the terminals, especially at the high voltage side, of the transformer can be reduced and the assembly efficiency can be increased. Further, the insulation characteristic of the coils with respect to the core is improved and the coils can be prevented from damaging.

What is claimed is:

1. A high voltage transformer comprising:

at least two coils each having lead wires, for generating a mutual induced electromotive force;

a core for forming a common magnetic path for said coils;

an insulation encompassing said coils; and an insulation support including a side insulating member disposed between said insulation of at least one of said coils and said core and a lead wire support integrally combined with said side insulating member and formed with spaced apart holes through which respective ones of said lead wires pass.

2. A high voltage transformer as claimed in claim 1, wherein said insulation support further includes a bottom insulating member disposed between the bottom of said at least one of said coils and said core.

3. A high voltage transformer as claimed in claim 1, wherein said side insulating member of said insulation support extends upward to the height of the other of said coils.

4. A high voltage transformer as claimed in claim 1, wherein said insulation support is made of plastics.

5. A high voltage transformer as claimed in claim 2, wherein said insulation support is made of plastics.

6. A high voltage transformer as claimed in claim 3, wherein said insulation support is made of plastics.

7. A high voltage transformer comprising:

a primary coil to which a commercial power supply is connected;

a secondary coil for inducing a high voltage necessary for driving a magnetron, with respect to said primary coil;

a heater coil for inducing voltage necessary for heating a negative electrode of the magnetron, with respect to said primary coil;

a core for forming a common magnetic path for said primary and secondary coils and said heater coil;

an insulation encompassing said primary, secondary and heater coils; and an insulation support including a side insulating member disposed between said insulation of said primary, secondary and heater coils and said core, a bottom insulating member disposed between the bottom of said secondary coil and said core and a lead wire support integrally combined with said side insulating member and said bottom insulating member and formed with holes through which respective ones of said lead wires of said secondary coil pass.

* * * * *